US006382986B1

(12) United States Patent
Kim et al.

(10) Patent No.: US 6,382,986 B1
(45) Date of Patent: May 7, 2002

(54) SOCKET FOR MOUNTING MEMORY MODULE BOARDS ON A PRINTED CIRCUIT BOARD

(75) Inventors: Jong-ryeul Kim, Seoul; Byung-se So, Sungnam, both of (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/612,610

(22) Filed: Jul. 8, 2000

(30) Foreign Application Priority Data

Jul. 8, 1999 (KR) ..... 99-27460
May 9, 2000 (KR) ..... 2000-24619

(51) Int. Cl.[7] ..... H01R 12/00
(52) U.S. Cl. ..... 439/74; 439/631; 439/69
(58) Field of Search ..... 439/74, 79, 71, 439/69, 631, 637, 629; 361/760

(56) References Cited

U.S. PATENT DOCUMENTS 3,591,834 A * 7/1971 Kolias ..... 439/71
4,685,031 A * 8/1987 Fife et al. ..... 361/413
4,998,897 A * 3/1991 Rose ..... 439/629
5,355,282 A * 10/1994 Yokemura et al. ..... 361/760

* cited by examiner

*Primary Examiner*—Brian Sircus
*Assistant Examiner*—J. F. Duverne
(74) *Attorney, Agent, or Firm*—Skjerven Morrill MacPherson LLP; David W. Heid

(57) ABSTRACT

A socket for mounting memory module boards on a printed circuit board (PCB) includes a first socket, a second socket and a third socket. The first socket includes a first socket body that receives a first memory module board, a first clip that connects to a tab of the first memory module board, and a first signal line connected to the first clip and extending outside of the first socket body. The second socket is in an area adjacent to the first socket and includes a second socket body that receives the first and a second memory module boards on opposite sides of the second socket body, two sets of upper socket pins disposed within the second socket body, and two sets of lower socket pins disposed to be opposite to the upper socket pins. The third socket is in an area adjacent to the second socket and includes a third socket body that receives the second memory module board, a second clip that connects to a tab of the second memory module board, and a second signal line connected to the second clip and extending outside of the third socket body.

7 Claims, 8 Drawing Sheets

SOCKET FOR MOUNTING MEMORY MODULE BOARDS ON A PRINTED CIRCUIT BOARD

BACKGROUND OF THE INVENTION

1. Field of the Invention

The present invention relates to a connecting apparatus for an electronic device, and more particularly, to a socket for mounting memory module boards on a printed circuit board (PCB).

2. Description of the Related Art

With the advance of technology, multi-media computer systems, servers, and workstations have experienced increasing needs for high-capacity, highly integrated and high-performance electronic devices. Memory modules particularly need to be small and fast devices. In many applications, the sockets that connect memory module boards to a PCB, are important factors in determining the performance of a computer system.

FIG. 1 is a cross-sectional view of a socket for mounting a memory module board on a general PCB. In FIG. 1, the socket is on a PCB 61 having a single-layer or multi-layer printed circuit pattern (not shown). The socket includes a socket body 51, upper socket pins 55, lower socket pins 57 and socket mounting posts 59. The socket mounting posts 59 can be soldered onto the PCB 61 to fix the socket on the PCB 61. In FIG. 1, a signal line 63 connects the upper and lower socket pins 55 and 57 to the printed circuit pattern of the PCB 61.

FIG. 2 is a perspective view illustrating a signal transmission system including sockets 65 for mounting memory module boards on a general PCB 61. In FIG. 2, when a unit memory module board 53 is inserted in a socket 65, input or output terminals of the memory module board 53 are connected to the signal lines of the PCB 61 (e.g., A of FIG. 2) through the socket 65. The signals transmitted to the PCB 61 are again transmitted to another memory module board 53 mounted in a neighboring socket 65. In FIG. 2, dotted lines indicate paths along which a signal line 63 within a socket 65 is connected to a neighboring socket 65 through the PCB 61.

In the case of a memory module board operating at a high frequency, impedance matching between the PCB 61, which is a main board, and the memory module board 53 is very important. If the impedances are improperly matched, phase inversion of signals may occur at the interface between the PCB 61 and the memory module board 53. This causes distortion of transmitted signals. Accordingly, a desired signal cannot be obtained or a signal arrival may be delayed. This effect becomes severe for faster and smaller memory modules.

Another problem with the conventional sockets of FIGS. 1 and 2 is that each socket can only accommodate a single memory module board, and each socket requires sufficient area for insertion of a memory module board. Accordingly, the memory module mounting area cannot be easily reduced, which is difficulty for miniaturized electronic systems.

SUMMARY OF THE INVENTION

To solve the above problems, an embodiment of the present invention provides a socket for mounting memory module boards on a printed circuit board. The socket can accommodate multiple memory module boards, reduce the area required for the memory module boards on the PCB, can suppress distortion of signals at the interface between memory module boards by directly conducting signals therebetween, and can speed up the process of fetching data.

One embodiment of the present invention is a socket for mounting memory module boards on a printed circuit board (PCB). The socket includes a socket body that accommodates at least two memory module boards, at least two sets of upper socket pins, and at least two sets of lower socket pins. The memory module boards are inserted and fixed between the upper socket pins and the lower socket pins. A signal line connects to the upper and lower socket pins within the socket body and extends outside of the socket body. In an exemplary embodiment, the socket body is formed of an insulator in an "I" shape, so as to be capable of mounting the memory module boards opposite sides, and further includes at least one socket mounting post for fixing on the PCB. The memory module boards inserted into the "I" shape socket body are parallel to the PCB.

Also, the upper socket pins may include a first upper socket pin for connecting the first memory module board, and a second upper socket pin for connecting second memory module board. Further, the lower socket pins may include a first lower socket pin for connecting the first memory module board, and a second lower socket pin for connecting second memory module board.

The signal line often connects to a signal line formed in or on the PCB.

Also, in the exemplary embodiment, socket pins in each set of upper or lower socket pins may connect within the socket body, to respective socket pins in another set of upper or lower socket pins. Alternatively, the two or more sets of upper socket pins are not connected to each other but are connected to the PCB. Similarly, socket pins in the two or more sets of lower socket pins can be electrically isolated from each other within the socket body and independently connected to the PCB.

According to another aspect of the present invention, a socket for mounting memory module boards on a printed circuit board (PCB) includes a first socket, a second socket and a third socket. The first socket includes a first socket body that receives a first memory module board, a first clip that connects to a tab of the first memory module board, and a first signal line connected to the first clip and extending outside of the first socket body. The second socket is in an area adjacent to the first socket and includes a second socket body that receives the first and a second memory module boards on opposite sides of the second socket body, two sets of upper socket pins disposed within the second socket body, and two sets of lower socket pins disposed to be opposite to the upper socket pins. The third socket is in an area adjacent to the second socket and includes a third socket body that receives the second memory module board, a second clip that connects to a tab of the second memory module board, and a second signal line connected to the second clip and extending outside of the third socket body.

Preferably, each of the first, second and third socket bodies further includes a socket mounting post, and the second socket body is separable into upper and lower parts thereby separating the upper and lower socket pins. Also, the second socket body preferably further includes a connector that attaches the upper part to the lower part.

In a preferred embodiment of the present invention, the memory module boards have tabs on the left and right sides thereof.

Also, the first clip, the upper and lower socket pins and the second clip are preferably configured such that signals from the tabs of the first and second memory module boards are serially connected without passing through the PCB, and the first and second signal lines are preferably connected to interconnections of the PCB to which the first and second sockets are fixed.

Also, the socket according to the present invention may further include at least one more socket having the same configuration as the second socket, between the first socket and the second socket. Here, at least one or more first clip, intermediate connection part of upper and lower socket pins and second clip may be additionally provided stacked vertically above or below one another within the first, second and third socket bodies.

Also, the memory module boards inserted into the first clip, the upper and lower socket pins and the second clip which are additionally provided in the first, second and third socket bodies, preferably have tabs on the left and right sides thereof.

The first clip, the upper and lower socket pins and the second clip which are additionally provided in the first, second and third socket bodies, are preferably configured such that signals from tabs of the memory module boards are serially connected without passing through the PCB. Alternatively, the first clip, the upper and lower socket pins and the second clip which are additionally provided in the first, second and third socket bodies, are configured such that they are not connected to another first clip, another sets of upper and lower socket pins and another second clip, respectively, within the first, second and third socket bodies.

According to the present invention, a socket for a board of a fast and miniaturized memory module enables the size of a PCB to be reduced by reducing the mounting area of the memory module board, thereby attaining miniaturization and integration of electronic systems. Also, signal distortion occurring at the interface between the PCB and the memory module board can be suppressed, thereby avoiding signal distortion and improving the fetching speed of data.

BRIEF DESCRIPTION OF THE DRAWINGS

The above aspects and advantages of the present invention will become more apparent by describing in detail exemplary embodiments thereof with reference to the attached drawings in which.

DESCRIPTION OF THE PREFERRED EMBODIMENTS

Exemplary embodiments of the present invention will be described below with reference to the attached drawings.

Figure 1:
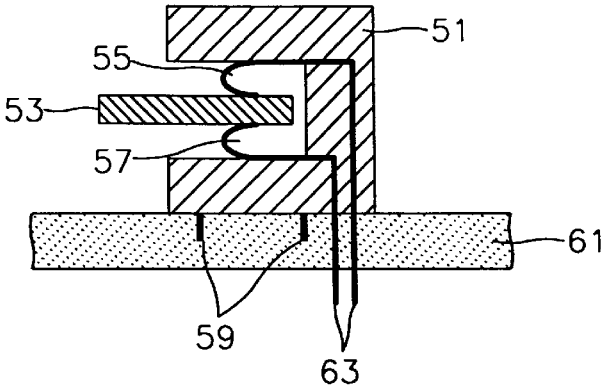
FIG. 1 (PRIOR ART)
FIG. 1 is a cross-sectional view of a socket for mounting memory module boards on a general printed circuit board.
Figure 2:
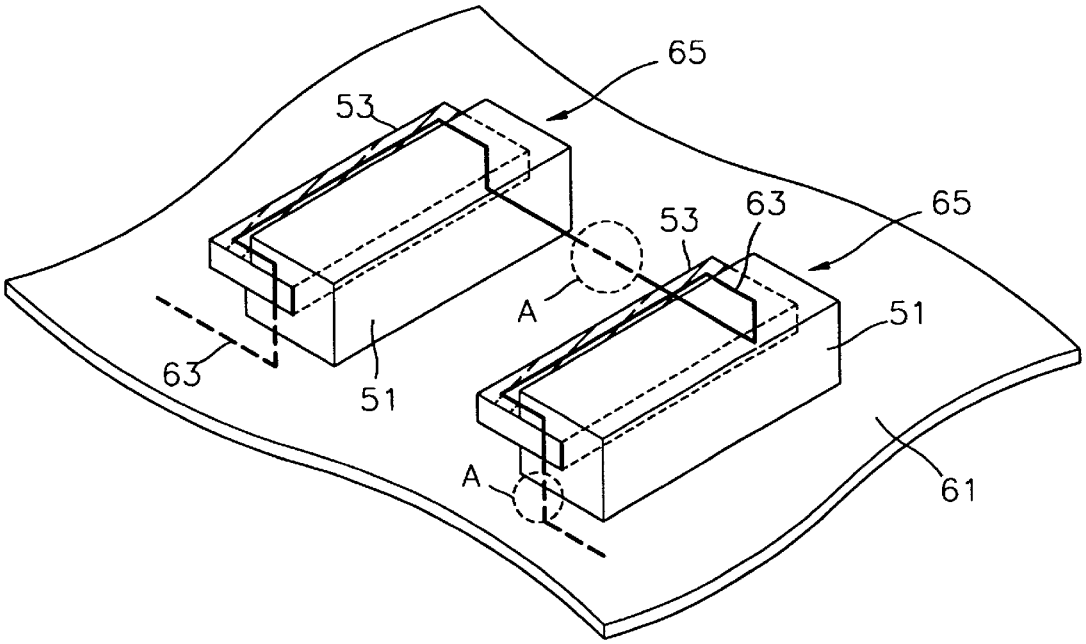
FIG. 2 (PRIOR ART)
FIG. 2 is a perspective view illustrating a signal transmission system including sockets for mounting memory module boards on a general printed circuit board.
Figure 3:
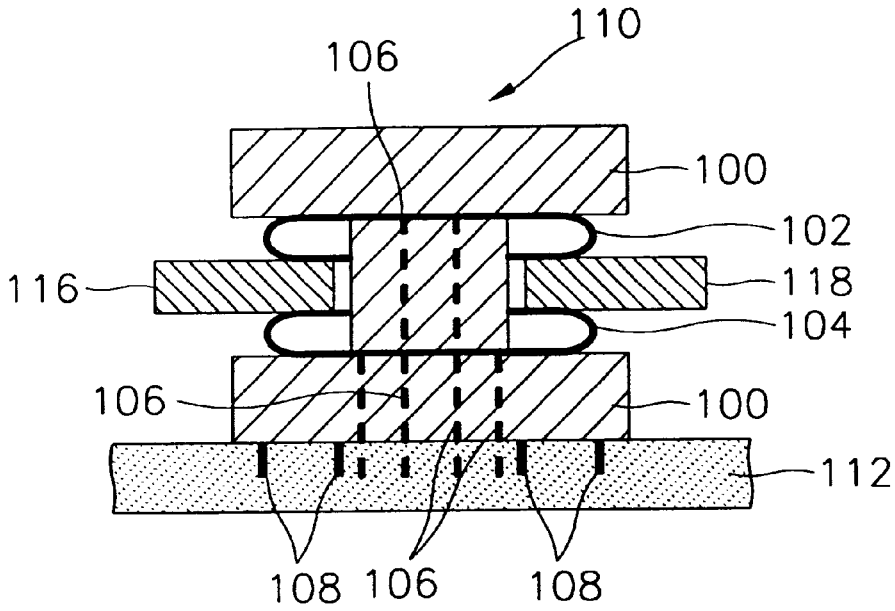
FIG. 3 is a cross-sectional view of a socket for mounting memory module boards on a printed circuit board according to a first embodiment of the present invention.

FIG. 3 shows a socket 110 for mounting memory module boards 116 and 118 on a printed circuit board (PCB) 112. The socket 110 includes a socket body 100, upper socket pins 102, lower socket pins 104, and signal lines 106. Socket body 100 is shaped to accommodate at least two memory module boards 116 and 118. The upper socket pins 102 and lower socket pins 104 are fixed in the socket body 100 and make electrical connections to memory module boards 116 and 118 that are inserted into the socket 110. The signal lines 106 extend outside of the socket body 100 and connected to a printed circuit pattern formed on the PCB 112, which is a main board.

If memory module boards 116 and 118 are inserted into the socket 110, the upper socket pins 102 are connected to tabs on upper surfaces of the memory module boards 116 and 118, and the lower socket pins 104 are connected to tabs on lower surfaces of the memory module boards 116 and 118. On the memory module boards 116 and 118, the tabs on the upper surfaces can either be electrically connected to or isolated from respective tabs on the lower surfaces. In the socket 110, each of the upper socket pins connected to the memory module board 116 is connected to a corresponding one of the upper socket pins that connects to the memory module board 118. Similarly, each of the lower socket pins connected to the memory module board 116 is connected in the socket body 100 to a corresponding one of the lower socket pins that connects to the memory module board 118. As indicated by dotted lines in the drawing, the signal lines 106 connect the upper and lower socket pins 102 and 104 to the printed circuit pattern formed on the PCB 112. Soldering can connect the signal lines 106 to the printed circuit in or on the PCB 112. The socket 110 also includes socket mounting posts 108 that can be soldered to the PCB 112 to fix the socket 110 to the PCB 112.

In the embodiment of FIG. 3, the socket body 100 is made of an insulating material that is formed in an 'I'shape to permit mounting memory module boards 116 and 118 on opposite sides of the socket 110. In particular, if connecting portions of the first and second memory module boards 116 and 118 are inserted between the upper and lower socket pins 102 and 104, the memory module boards 116 and 118 are parallel to the PCB 112 and extend in opposite directions from the socket 110. This configuration reduces the required memory module mounting area when compared to the area that two conventional sockets containing memory module boards occupy. Thus, the socket 110 is compatible with the demands for miniaturization of electronic systems. Since the mounting area is reduced, the size of the PCB 112, which is a main board, can also be reduced.

The embodiment of the socket 110 in FIG. 3 includes two sets of each of the upper socket pins 102 and lower socket pins 104. Here, the PCB 112 contains a single-layer or multiple-layer type conductive printed circuit pattern (not shown) which connects two different electronic devices, e.g., transmits signals between two memory module boards or signals of a memory module board to another electronic device.

In one embodiment, the signal lines 106 for the memory module boards 116 and 118 are connected to each other such that the same signals correspond to each other within the socket body 100. In this case, when two memory module boards are mounted on a PCB, signals are directly transmitted between the memory module boards 116 and 118 within the socket 110, unlike in the conventional case in which the signals are transmitted by a signal line through the PCB 112. Thus, socket 110 avoids the signal distortion that may occur at the interconnection of the connecting portion of the socket 110 and the PCB 112. Also, since the signals are not transmitted through the PCB 112, the transmission speed of the signals can be enhanced.

Figure 4:
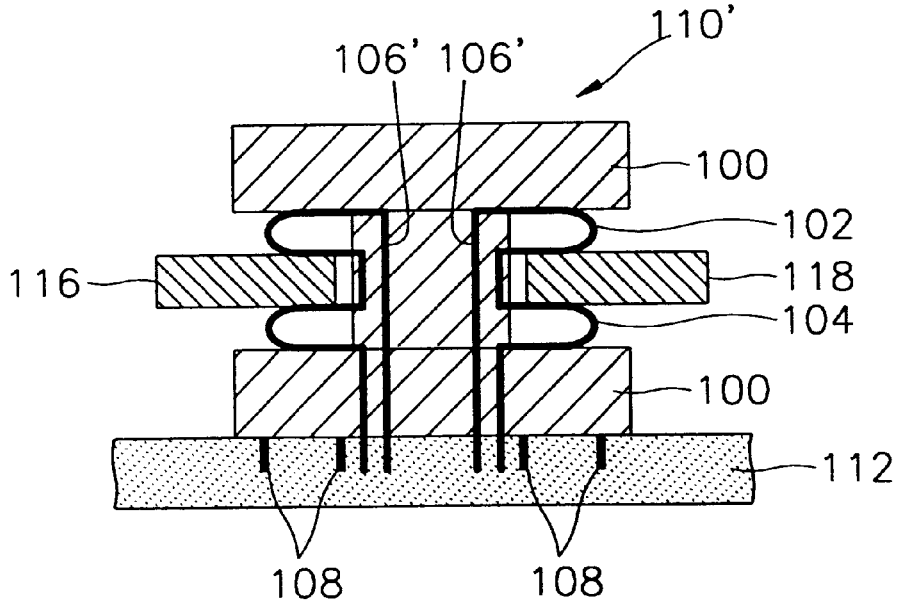
FIG. 4 is a cross-sectional view of a socket for mounting memory module boards on a printed circuit board according to a second embodiment of the present invention.

FIG. 4 is a cross-sectional view of another embodiment of a socket 110' for mounting memory module boards used in a printed circuit board according to the present invention.

The socket 110' has the same configuration the socket 110 of FIG. 3, except for the structure of the signal lines 106 and 106' and the upper and lower pins 102 and 104. In this embodiment, the signal lines 106' for the left and right sets of upper and lower pins 102 and 104 are not connected to each other within the socket body 100. Accordingly, the signal lines 106' for first and second memory module boards 116 and 118 are independently connected to the PCB 112, so that signal distortion is possible at the interface between the lines 106' and the PCB 112. However, this structure still allows reduction in the mounting area and the size of the PCB 112. The signal lines 106' for the memory module boards 116 and 118 while not connected to each other in the socket body 100, can still be connected in the PCB 112, so that the identical signals correspond to each other.

Figure 5:
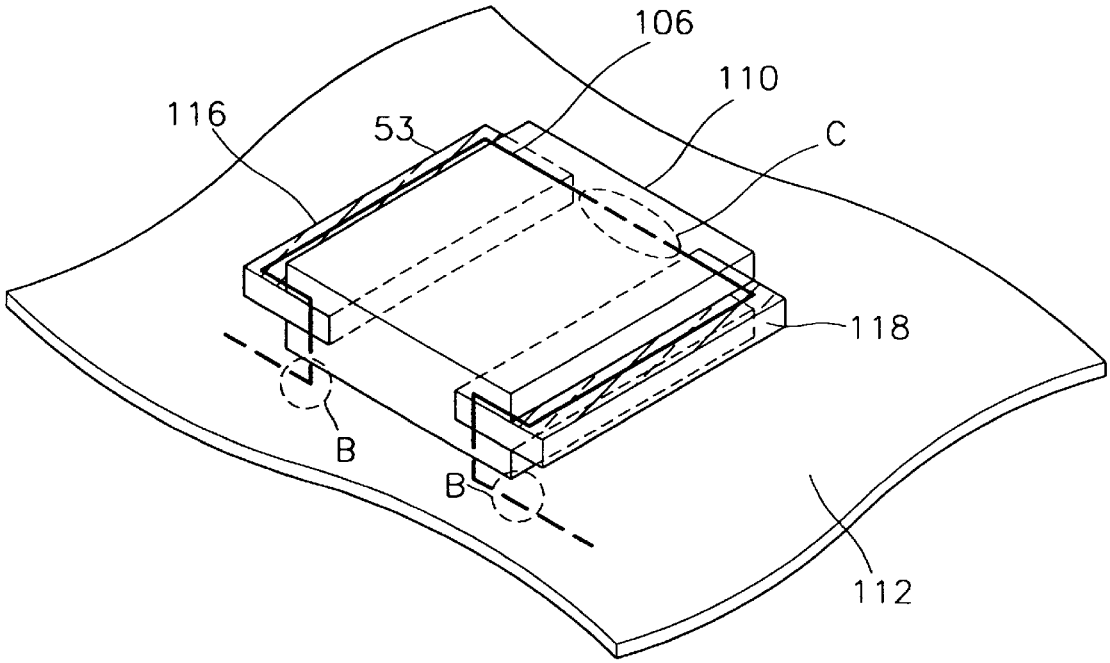
FIG. 5 is a perspective view illustrating a signal transmission system in the socket for mounting memory module boards on the PCB according to the first embodiment of the present invention.

FIG. 5 is a perspective view illustrating a signal transmission system in a socket according to the present invention for mounting memory module boards on the PCB. In FIG. 5, at least some of the signal lines 106 for the memory module boards 116 and 118 are connected to each other within the socket 110. Thus, when signals are transmitted between two memory module boards 116 and 118, direct transmission of signals is allowed within the socket 110, without using a printed circuit pattern formed on the PCB 112. A portion "B" in FIG. 5 shows where the PCB 112 and the socket 110 interface. A portion "C" indicates a connection that conventionally would pass through the PCB 112 but in the embodiment of FIG. 5, remains in the socket 110 and does not cross the interface between the socket 110 and the PCB 112. In the case of a conventional socket for mounting two memory module boards, there would be four interface crossings. In the embodiment of FIG. 5, there are only two interface crossings, that is, at a portion "B", thereby shortening a time required for fetching signals that traverse the path illustrated in FIG. 5. In transmitting signals between memory module boards in this manner, the socket 110 can suppress signal distortion and delay. This is particularly effective when applied to memory modules operating at higher frequencies such as a RAMBUS DRAM.

Figure 6:
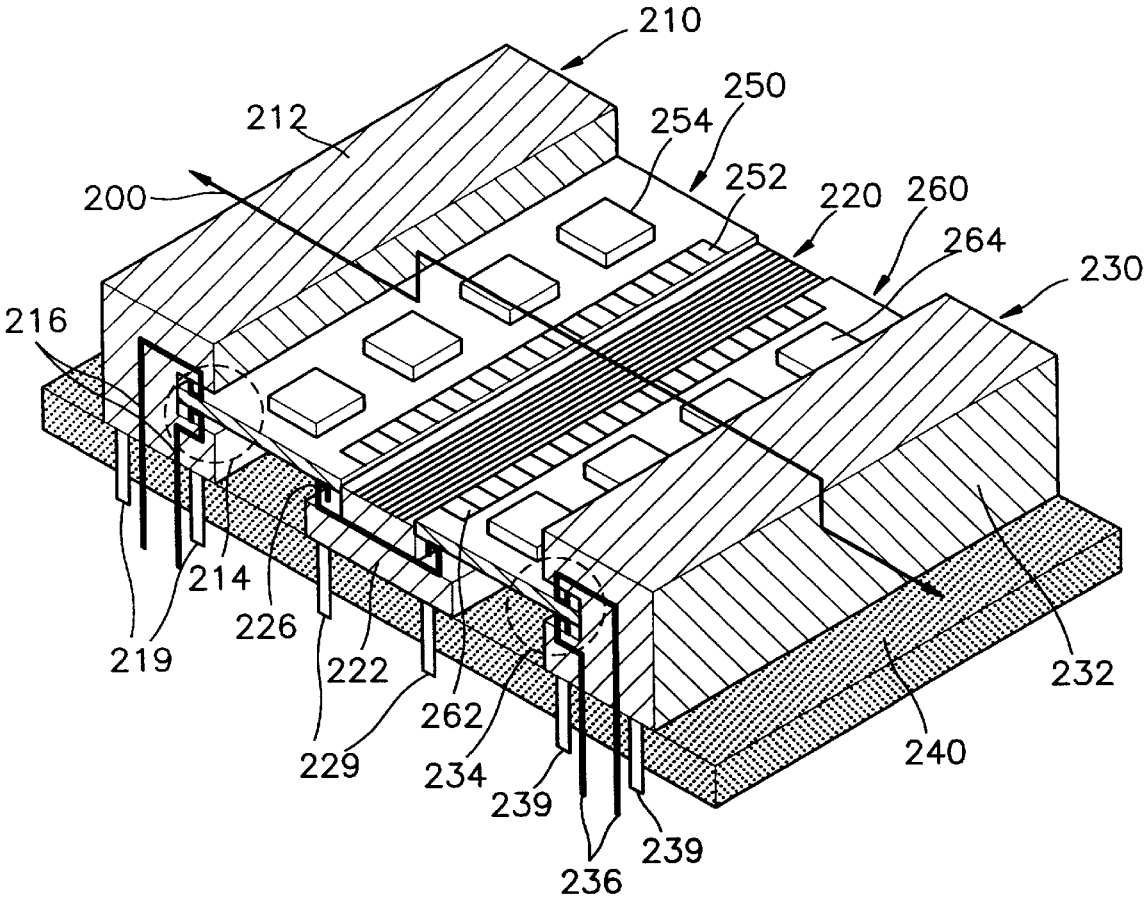
FIG. 6 is a perspective view of a portion of a socket system according to a third embodiment of the present invention for mounting memory module boards on a printed circuit board.

FIG. 6 is a perspective view illustrating a socket system according to a third embodiment of the present invention for mounting memory module boards on a printed circuit board. In FIG. 6, the socket is an assembly including first and third sockets 210 and 230 of a conventional type, and a second socket 220, which is similar to the socket according to the first embodiment of the present invention.

Figure 7:
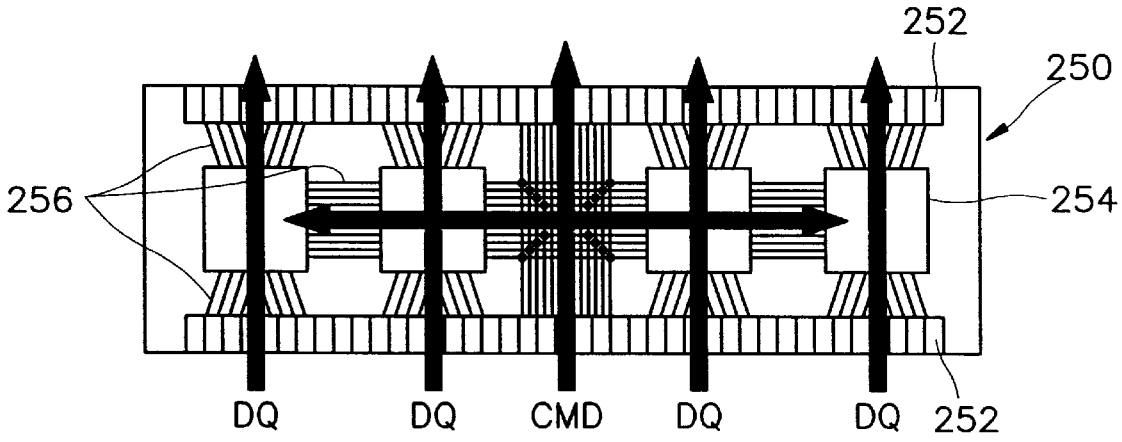
FIG. 7 is a plan view illustrating a memory module board used in the third embodiment of the present invention.
Figure 8:
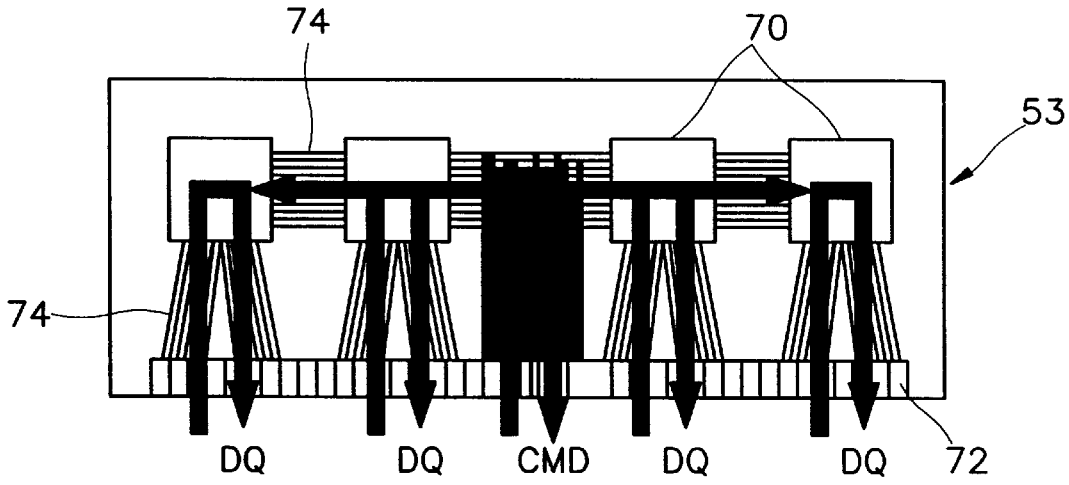
FIG. 8 (PRIOR ART)
FIG. 8 is a plan view illustrating signal path of a conventional memory module board.

The memory module boards used in the third embodiment have tabs two edges, that is, at left and right edges, as shown in FIG. 7, unlike the conventional memory module boards having tabs at only one edge, as shown in FIG. 8.

In FIG. 6, the first socket 210 includes a first socket body 212, a first clip 214, a first signal line 216, and a first socket mounting post 219. The first socket body receives a first memory module board 250, which is inserted in one direction. The first clip 214 electrically contacts tabs 252 of the first memory module board 250 when the first memory module is inserted into the first socket body 212. The first signal line 216 connects to the first clip 214 and extends out of the first socket body 212 for connection to a printed circuit pattern (not shown) inside a PCB 240. The clip 214 includes upper and lower pins that contact upper and lower surfaces of tabs on the first memory module board 250. The first socket mounting post 219 connects and secures the first socket body 212 to the PCB 240.

The second socket 220 is in an area adjacent to the first socket 210 and is close enough that when the first memory module board 250 is in the first socket 210, tabs of the first memory module board contact lower pins 226 of the second socket 220. FIG. 6 shows only a lower portion of a socket body 222 for the second socket 220. An upper portion of the socket body is detachable and illustrated in FIG. 9. The socket body 222 accommodates two memory module boards 250 and 260, mounted on opposite sides of the second socket body 222. The second socket 220 further includes two sets of lower socket pins 226, which are disposed opposite to two sets of upper socket pins (224 of FIG. 10) when the lower and upper portions of socket body 222 are connected. Here, the two sets of upper and lower socket pins 224 and 226 connect to tabs of the first and second memory module boards 250 and 260 that are mounted on both opposite sides of the second socket 220.

The second socket mounting posts 229 connect and secure the lower portion of the second socket body 222 to the PCB 240. Connection of the upper portion of the second socket body to the lower portion is described further below in regard to FIGS. 9 and 10.

The third socket 230 mirrors the configuration of the first socket 210 and includes a second clip 234 that accepts the memory module board 260, which is inserted in a direction opposite the direction of insertion of the first memory module board 250 in the first socket 210.

The socket according to the third embodiment of the present invention can serially connect signals of two memory module boards 250 and 260 through the upper and lower socket pins 224 and 226, without passing signals through an intermediate medium, e.g., the PCB 240. Therefore, signal distortion occurring at interfaces between the PCB 240 and the sockets 210, 220 and 230 can be reduced, and the signal transfer speed can be increased. The socket also has advantages when used for miniaturized electronic devices, such as notebook type computers or other portable computers because multiple memory module boards can be mounted in close proximity on a PCB.

Additionally, the memory module boards have tabs on two edges which permits a reduction in the size of the memory module boards.

In the socket according to the third embodiment of the present invention, the path of signal transmission indicated by reference numeral 200 in FIG. 6 provides a serial connection in which signals from the PCB 240 travel through the first signal line 216, the first clip 214, the first memory module board 250, the upper and lower socket pins 224 and 226 of the second socket 220, the second memory module board 260, the second clip 234, and the second signal line 236 back to the PCB 240.

Here, the upper and lower socket pins 224 and 226 serially connect the signal of the tabs 252 of the first memory module board 250 to the tabs 262 of the second memory module board 260. Reference numerals 254 and 264 denote semiconductor memory devices mounted on the first and second memory module boards 250 and 260.

FIG. 7 is a plan view illustrating a memory module board used in the third embodiment of the present invention, and FIG. 8 is a plan view illustrating a conventional memory module board. In FIGS. 7 and 8, reference numerals 254 and 70 denote semiconductor memory devices mounted on the memory module boards 250 and 53, respectively. In the conventional memory module board 53 shown in FIG. 8, tabs 72 connected to signal lines 74 is only at one edge of the memory module board 53. Thus, since signal lines 74 for a command (CMD) signal, e.g., CE (Chip Enable) or OE (Output Enable) signal, and the signal lines 74 for outputting data DQ, must enter and exit at the one-sided tabs 72, a large number of pins are required in a small area.

Figure 9:
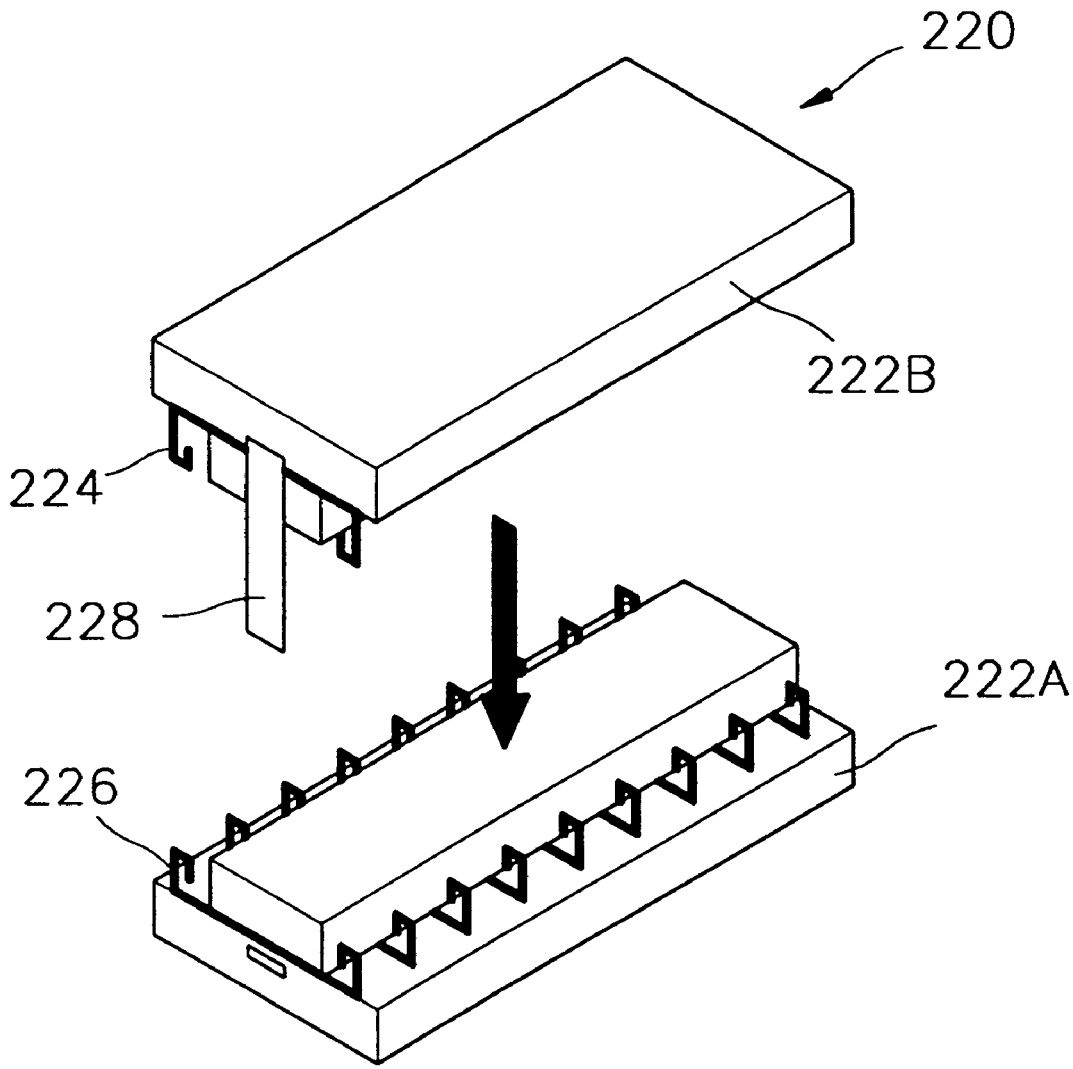
FIG. 9 is a perspective view illustrating components of a socket used in the third embodiment of the present invention.
Figure 10:
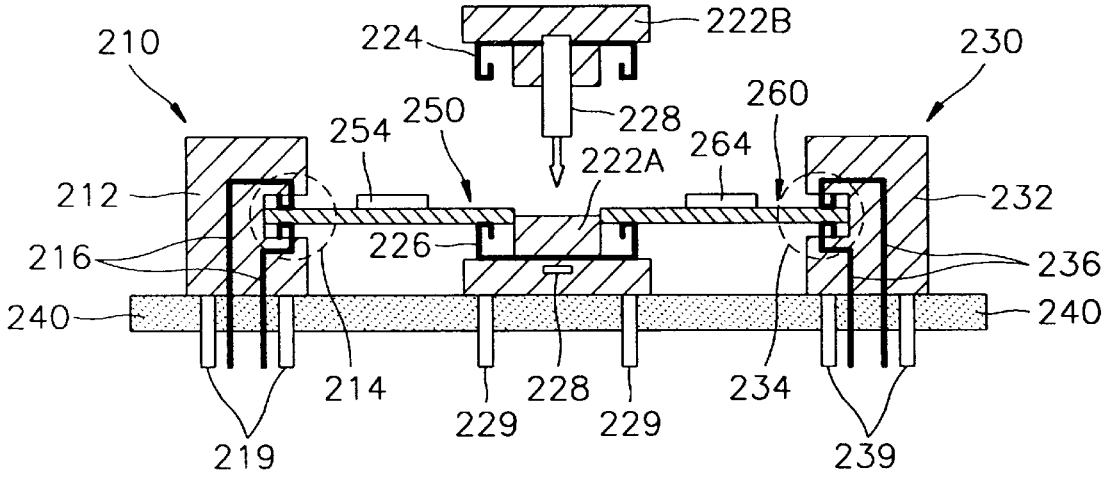
FIG. 10 is a cross-sectional view illustrating the principle on which memory module boards are mounted in a socket system according to the third embodiment of the present invention.
Figure 11:
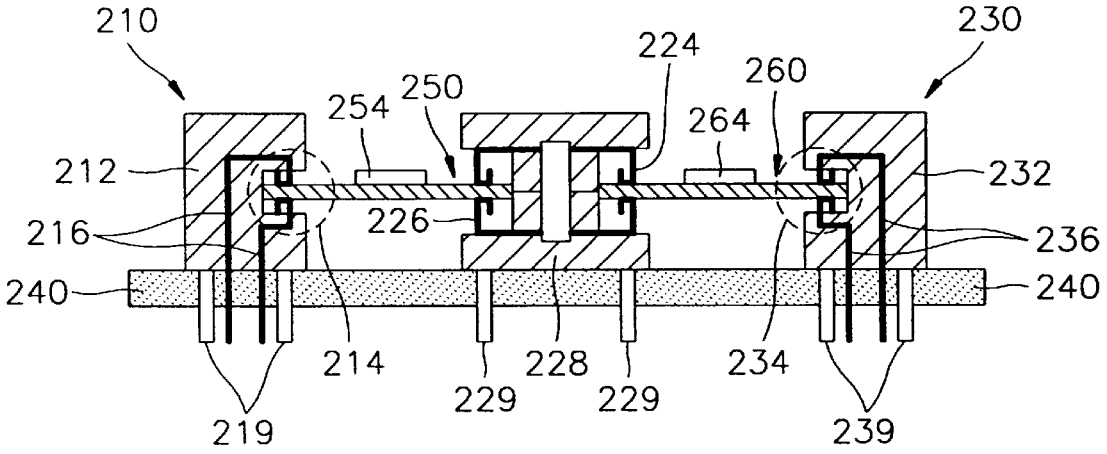
FIG. 11 is a cross-sectional view illustrating a state in which memory module boards are mounted in a socket system according to the third embodiment.

However, the memory module board 250 has the tabs 252 on opposite edges, as shown in FIG. 7, thereby doubling the available area for the tabs 252. Thus, the memory module board 250 can have a lower density of pins in tabs 252 or alternatively a smaller size than in the conventional case. Also, in a common configuration, signal lines for signals CMD and DQ are serially connected as indicated by arrows in FIGS. 7 and 8. Accordingly, signal flow can be routed from one edge of the memory module board 250 to the other, unlike in the memory module board 53 where signal lines enter and leave from the same edge. Accordingly, design of a memory module board having the configuration of FIG. 7 can be simplified. In the case of a multiple-layer PCB, a memory module board can be fabricated with fewer layers. FIG. 9 is a perspective view illustrating the second socket 220 of FIG. 6. Referring to FIG. 9, the second socket body is separable into a lower portion 222A including the lower socket pin 226 and an upper portion 222B including the upper socket pin 224. When the lower and upper portions 222A and 222B are separated, two memory module boards are placed on opposite sides of the lower portion 222A. The upper and lower portions 222A and 222B are then securely connected to each other by a connector 228 formed at one or both ends of portion 222A or 222B. In FIG. 9, the connector 228 includes flexible arms that extend from both ends of the upper portion 222B and slots at both ends of the lower portion 222A. Each arm includes a projection that snaps into a corresponding slot to hold the lower and upper portions 222A and 222B together. FIG. 10 is a cross-sectional view illustrating the mounting of memory module boards in the socket according to the third embodiment of the present invention. Initially, the upper portion 222B of the second socket body is separated from the lower portion 222A. An edge of the first memory module board 250 is then inserted into the first clip 214 of the first socket 210, leaving the opposite edge of the first memory module board 250 resting on a first side of the lower portion 222A of the second socket body. Then, an edge of the second memory module board 260 is inserted into the second clip 234 of the third socket 230, leaving the opposite edge of the second memory module board 260 resting on a second side of the lower portion 222A of the second socket body. Thereafter, the upper portion 222B of the second socket body is connected to the lower portion 222B and held in place by the connector 228. FIG. 11 is a cross-sectional view illustrating memory module boards mounted in the socket according to the third embodiment of the present invention. In FIG. 11, signal transmission is in the socket so that signals are directly transmitted to or from the first clip 214 through the first memory module board 250, the upper and lower socket pins 224 and 226, and the second memory module board 260 from or to the second clip 234. Thus, the path of signal transmission is short and signal distortion is noticeably reduced. Therefore, the socket having the aforementioned configuration can improve the overall performance of the system.

Figure 12:
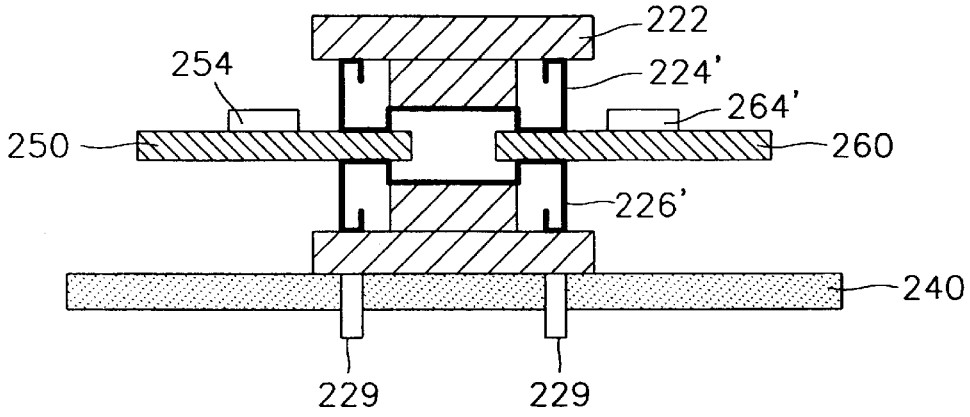
FIG. 12 is a cross-sectional view illustrating a modification of the central socket in the third embodiment of the present invention.

In the above-described embodiment, the second socket 220 is between the first socket 210 and the third socket 230, and two memory module boards 250 and 260 are mounted at either side of the second socket 220. However, one or more sockets similar or identical to the second socket 220 may be provided between the first socket 210 and the third socket 230. With multiple intervening sockets, more memory module boards can be mounted. For example, three or more memory module boards can be mounted in a socket system with two or more sockets identical to second socket 220 between the first socket 210 and the third socket 230. Such modifications allow signal transmission using sockets only without passing signals through the PCB 240. Thus, the path of signal transmission is short and signal distortion is noticeably reduced. FIG. 12 is a cross-sectional view illustrating a modification of the second socket in the socket system according to the third embodiment of the present invention. Referring to FIG. 12, upper and lower socket pins 224' and 226' are mounted in the reverse of the arrangement direction of the upper and lower socket pins 224 and 226 shown in FIG. 9. This modification minimizes the length of an electrical wire within the socket so that the path length of signal transmission can be reduced.

Figure 13:
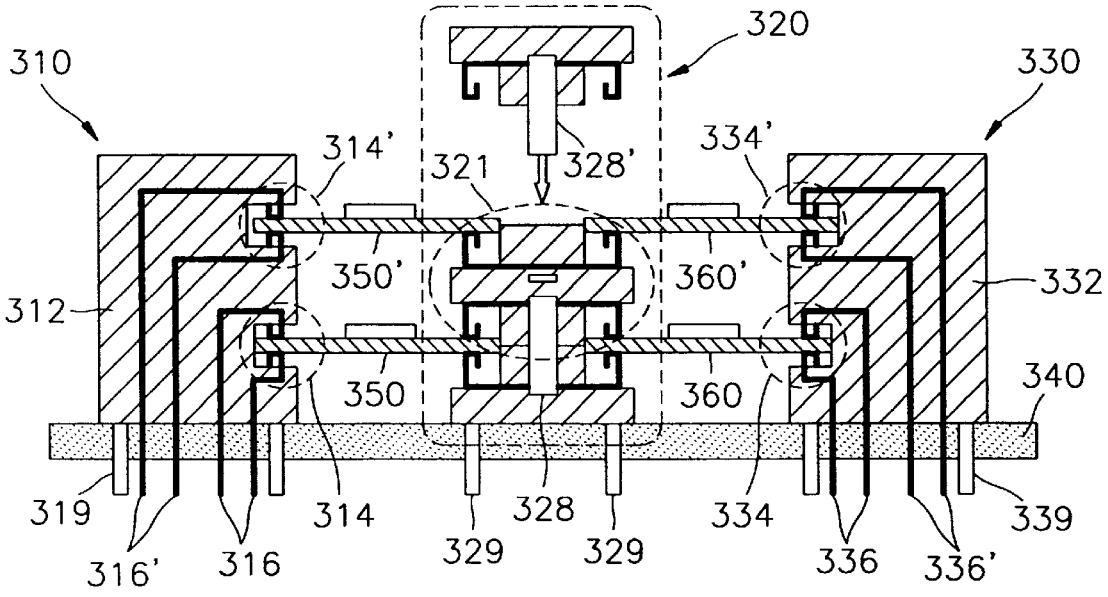
FIG. 13 is a cross-sectional view of a socket system according to a fourth embodiment of the present invention, for mounting memory module boards on a printed circuit board.

FIG. 13 is a cross-sectional view of a socket system for mounting memory module boards according to a fourth embodiment of the present invention.

In the first through third embodiments described herein, one memory module board is mounted on opposite sides of at least one of the sockets. However, according to the fourth embodiment of the present invention, multiple memory module boards can be mounted on each side of a socket. Referring to FIG. 13, a first socket 310 includes a socket body 312 and first clips 314 and 314'. A second socket 320 includes three separable portions, lower and upper portions which are substantially similar to the lower and upper portions 222A and 222B shown in FIGS. 9 and 10, and an intermediate portion 321. The intermediate portion 321 includes upper socket pins matching the lower socket pins in the lower portion, and lower socket pins matching the upper socket pins in the upper portion. A third socket 330 includes a socket body 332 and second clips 334 and 334'.

The first, second and third sockets 310, 320 and 330 of FIG. 13 permit mounting four memory module boards 350, 350', 360, and 360'. More particularly, the one edge of the memory module board 350 contacts clip 314 and the other edges contacts the upper and lower pins of the intermediate and lower portions of the socket 320. The memory module board 350' is mounted above the memory module board 350 and connects to the clip 314' in the socket 310 and between the intermediate and upper portions of the second socket 320. Similarly boards 360 and 360' are between the second socket 320 and the third socket 330, with the memory module board 360' above the memory module board 360. Therefore, according to this embodiment, more memory module boards can be mounted on one socket. Here again, suitable memory module boards used in this case have tabs at both sides.

Since the configuration in which the first clip 314', the upper and lower socket pins 321 and the second clip 334' are further provided in the socket for mounting memory module boards according to the fourth embodiment of the present invention is substantially the same as that of the third embodiment, signals of memory module boards can be serially transmitted without passing through a PCB 340. Additionally, connections can be provided within the first and second sockets for further serial transmissions. Alternatively, signal lines 316 and 316' can be connected to each other or not within a first socket body 312. In the illustrated embodiment, the signal lines 316 and 316' are independently connected to interconnections in the PCB 340. The interconnections of signal lines 336 and 336' have similar options for connect to each other and/or the PCB 340.

As noted above, the second socket body of the second socket 320 is divided into an upper portion, a lower portion and the intermediate portion 321. The upper and lower portions are substantially the same as upper and lower portions 222B and 222A (FIG. 9), and the intermediate portion 321 is a fusion of upper and lower portions 222B and 222A.

The memory module boards are mounted as follows. Initially, only the lower portion of the second socket 320 is in place. Two memory module boards 350 and 360 are first mounted in the clips 314 and 334 and the lower portion, and the intermediate portion 321 of the second socket 320 is then connected to the lower portion. Here, a connector 328 on the intermediate portion 321 fixes the intermediate portion 321 to the lower portion. Thereafter, two memory module boards 350' and 360' are mounted in clips 314' and 334' and the intermediate portion 321. Finally, a connector 328' connects the upper portion of the second socket 320 to the intermediate portion 321.

Since the socket for mounting memory module boards according to the fourth embodiment of the present invention can mount two or more times as many memory module boards per socket as the socket according to the third embodiment of the present invention, it is suitably used in a memory system requiring a large capacity.

Therefore, according to an aspect of the present invention, the mounting area of memory module boards for miniaturized fast operating memory devices can be reduced, and thus the size of a printed circuit board, which is a main board, can be reduced, thereby attaining miniaturization and integration of an electronic device. Additionally, signal distortion can be suppressed at the interfaces between the main board, that is, a PCB, and the memory module boards, and the speed of fetching data from the system can be increased.

Not-limiting, explanatory embodiments of the invention have been described above. Various modifications and supplements may be made to those embodiments without going beyond the spirit and scope of the invention as defined in the appended claims.

What is claimed is:

1. A socket system for mounting memory module boards, comprising: a first socket comprising:

a first socket body into which a first edge of a first memory module board and a first edge of a second memory module board are inserted;

a first clip positioned in the first socket body so as to connect to the first edge of the first memory module board when the first memory module board is inserted into the first socket body;

a second clip positioned in the first socket body so as to connect to the first edge of the second memory module board when the second memory module board is inserted into the first socket body; and a first signal line connected to the first clip and extending outside of the first socket body;

a second socket comprising:

a second socket body into which a first edge of a third memory module board and a first edge of a fourth memory module board are inserted;

a third clip positioned in the second socket body so as to connect to the first edge of the third memory module board when the third memory module board is inserted into the second socket body;

a fourth clip positioned in the second socket body so as to connect to the first edge of the fourth memory module board when the fourth memory module board is inserted into the second socket body; and second signal line connected to the third clip and extending outside of the second socket body; and a third socket positioned between the first socket and the second socket, comprising:

a third socket body shaped to accept the first and second memory module boards on a first side of the third socket body and the third and fourth memory module boards on a second side of the third socket body;

a first set of socket pins positioned to connect to a second edge of the first memory module board;

a second set of socket pins positioned to connect to a second edge of the second memory module board;

a third set of socket pins positioned to connect to a second edge of the third memory module board; and a fourth set of socket pins positioned to connect to a second edge of the fourth memory module board.

2. The socket system according to claim 1, wherein each of the first, second and third socket bodies further includes a socket mounting post.

3. The socket system according to claim 1, wherein each of the first and second edges of the first, second, third, and fourth memory module boards has tabs.

4. The socket system according to claim 1, wherein the first, second, third, and fourth sets of socket pins are connected between the socket pins of other sets such that signals pass between the first, second, third, and fourth sets of socket pins.

5. The socket system according to claim 1, wherein the first and second signal lines are connected to a motherboard.

6. The socket system according to claim 1, wherein the third socket body comprises separable upper, middle, and lower portions, wherein the upper portion can be removed for accepting the first and third memory module boards between the upper and middle portions, and the middle portion can be removed for accepting the second and fourth memory module boards between the middle and lower portions.

7. The socket system according to claim 6, wherein the third socket body further includes a connector that connects the upper, middle, and lower portions.

* * * * *